US007292126B2

(12) United States Patent
So

(10) Patent No.: US 7,292,126 B2
(45) Date of Patent: Nov. 6, 2007

(54) LOW NOISE PLANAR TRANSFORMER

(75) Inventor: Kelvin Wing Chi So, Shalin (HK)

(73) Assignee: Astec International Limited (HK)

( * ) Notice: Subject to any disclaimer, the term of this patent is extended or adjusted under 35 U.S.C. 154(b) by 30 days.

(21) Appl. No.: 10/837,398

(22) Filed: Apr. 30, 2004

(65) Prior Publication Data

US 2005/0242916 A1 Nov. 3, 2005

(51) Int. Cl.
*H01F 5/00* (2006.01)
*H01F 7/06* (2006.01)

(52) U.S. Cl. ..... 336/200; 336/223; 336/232; 29/602.1

(58) Field of Classification Search ..... 336/200
See application file for complete search history.

(56) References Cited

U.S. PATENT DOCUMENTS 5,184,103 A * 2/1993 Gadreau et al. ..... 336/84 C
5,990,776 A * 11/1999 Jitaru ..... 336/200
6,211,767 B1 4/2001 Jitaru ..... 336/200
6,628,531 B2 * 9/2003 Dadafshar ..... 361/836
6,707,690 B1 * 3/2004 Bottrill ..... 363/21.16
2004/0032313 A1 * 2/2004 Ferencz et al. ..... 336/200

* cited by examiner

*Primary Examiner*—Anh Mai
*Assistant Examiner*—Joselito S. Baisa
(74) *Attorney, Agent, or Firm*—Nixon Peabody LLP

(57) ABSTRACT

An apparatus and method for reducing common mode noise capacitive coupling from a primary winding to a secondary winding in a transformer. In an embodiment, the primary winding has two terminals and a plurality of coil turns therebetween formed by a plurality of PCB layers sandwiched together, each having at least one of the coil turns formed thereon. The coils turns are connected in a predetermined way to form the primary winding. One terminal of the primary winding is connected to a coil turn on a first one of the PCB layers, and the other terminal is connected to a coil turn on a second one of the PCB layers. The PCB layers are stacked to form the primary winding. The secondary winding or windings are positioned adjacent to a selected one of the stacked PCB layers that is in a position between the first and second PCB layers.

14 Claims, 10 Drawing Sheets

LOW NOISE PLANAR TRANSFORMER

FIELD OF INVENTION

The present invention relates to transformers, and more particularly a low noise planar transformer and a method of construction thereof.

BACKGROUND OF THE INVENTION

Electromagnetic components such as transformers have traditionally been constructed by winding one or more conductors about a cylindrical or toroidal core. This method of construction requires that a conductor, such as a wire, be wrapped around the outer surface of the core. The resulting components are expensive and time consuming to manufacture, and do not readily lend themselves to miniaturization or automated assembly.

More recently, electromagnetic components have been constructed using printed circuit board (PCB) manufacturing techniques, where windings and individual winding turns are formed from a stack of PCB layers wherein each layer includes one or more conducting traces patterned on the surface of the PCB layer, or formed from a multi-layer PCB having such conducting traces on each layer. The use of PCB conductive traces as windings has several advantages over conventional, wound windings. First, the assembled PCB winding has a smaller mounting footprint than conventional windings, since it does not need extra leads or soldering pads. Second, the PCB winding assembly is much simpler than conventional windings, since the winding and other components in the winding circuit of a multilayer PCB can be board mounted using the same reflow and automation processes used to mount other components. Third, a multi-layer PCB winding has improved reliability since the likelihood of shorting across adjacent turns of the winding is greatly reduced or substantially eliminated.

In a multi-layer PCB, a PCB winding is formed from a plurality of patterned conductive traces, typically of copper, each formed on a separate insulating layer of the multi-layer PCB. Each trace forms a nearly closed typically circular pattern, so as to create the electromagnetic equivalent of one turn or loop of a prior art wire formed winding. Terminal points are formed at the ends of each trace for making connections to other traces on other layers, so as to form the individual turns of the winding. For example, the pattern can be a "C" shape with a terminal point at each of the two extreme points of the C. The PCB winding is formed by connecting the traces from different layers of the PCB through the intervening insulating PCB layers. These connections are typically plated through holes or vias in the PCB insulating layers. The traces can be connected in various ways. The traces can all be connected in series to form a winding where each trace is a separate turn of the winding. In this example, the terminal ends of each trace are offset from the traces on the adjacent levels, so that the plated through holes in each level do not intersect. Two or more traces can also be connected in parallel to decrease the impedance of a particular turn of the winding. In yet another alternate embodiment, one or more of the traces can be formed as separate windings. In each case, the resultant winding (or windings) is a function of the way in which the conductive traces on each layer of the multi-layer PCB are connected together and coupled to external circuits, to thereby create a planar transformer.

The inductance of a winding formed using a multi-layer PCB can be increased by introducing a core of a magnetic material through an aperture formed in the PCB layers that extends through a central non-conducting region of each layer. Alternatively, the core can be configured to surround the PCB. The core is typically included as part of a housing for the multi-layer PCB winding. Conductive leads or vias are included on one or more of the PCB layers to enable the efficient electrical connection of the PCB winding to an external circuit, for example, by surface mounting and reflow soldering of the PCB winding to another PCB having other circuit components. This use of a multi-layer PCB to fabricate electromagnetic components results in smaller, more easily manufactured, and more reproducible components than is possible using a winding formed from a wire wrapped about a core.

In order to achieve better coupling and to reduce the leakage inductance of the transformer, the primary and secondary windings of the transformer are typically placed in close proximity to one another. One drawback of this arrangement is that it increases the capacitive coupling between the primary and secondary windings, which results in the generation of increased electromagnetic interference (EMI). That is, due to the inter-winding capacitance of the transformer, common mode noise will be injected into the secondary. In a planar, low profile transformer required for low profile packaging, this inter-winding capacitance is larger and, as a result, the common mode noise injection via this parasitic capacitance is larger.

This drawback is especially significant for a two switch forward converter. Unlike in a single switch forward converter, the primary winding in a two switch forward converter is not connected to either the positive or the return side of the converter's input voltage. The switches in the two switch forward converter are typically MOSFETs. The converter having MOSFET switches is also referred to herein as a two FET forward converter.

FIG. 1 shows a prior art two FET forward converter 10. The converter 10 has an input terminal 14 to which an input DC voltage, $V_{in}$, is coupled, relative to a ground potential at an input terminal 16, and an output terminal 32 where the output DC voltage, $V_{OUT}$, is provided relative to ground. Converter 10 includes a transformer 42 having primary winding 2 and a secondary winding 6. Each winding has a first and second end. A first power switch 34 is coupled between the first end of primary winding 2 and input terminal 14. A second power switch 36 is connected between the second end of primary winding 2 and input terminal 16. Power switch 34 is connected in series with primary winding 2 and power switch 36 across the input DC voltage terminals. A diode 18 is connected between the second end of primary winding 2 and input terminal 14. The diode 22 is connected between the first end of primary winding 2 and input terminal 16. Each of the power switches 34, 36 is preferably a MOSFET having a source, a drain, and a gate. A controller (not shown) preferably provides a control signal, e.g. a pulse width modulated (PWM) signal, coupled to each control input of power switches 34 and 36.

On the secondary side of the forward converter 10, transformer 42 has a secondary winding 6 having a second end connected to output terminal, 38. Converter 10 includes an inductor 24 connected in series with a diode 26 between output terminal 32 and the first end of secondary winding 6. A capacitor 28 is connected across the output terminals 32, 38. A diode 44 is connected between the junction of the cathode of diode 26 and inductor 24 and output terminal 38.

As shown in FIG. 1, converter 10 has a primary winding 2 having two terminals 7 and 9. Primary winding terminal 7 is connected to the source terminal of switch 34. Primary winding terminal 9 is connected to the drain terminal of switch 36. For the two switch forward converter 10, the voltage swing at primary winding terminals 7 and 9 is at a maximum during normal operation. If primary winding terminals 7 and 9 are located near the secondary winding 6 of transformer 42, a significant amount of common mode noise is coupled from the primary side to the secondary side of the transformer 42 due to the capacitance between primary winding 2 and secondary winding 6. This coupled common mode noise increases EMI for converter 10.

U.S. Pat. No. 5,990,776 ("the '776 patent") discloses a single ended switch forward converter that includes one FET switch for switching the primary winding. The '776 patent discloses a primary-secondary-primary ("pri-sec-pri") type transformer construction. The '776 patent discloses a transformer wherein all of the primary and secondary windings are integrated in a PCB.

The '776 patent teaches that the top winding 72 connected to the input voltage source is the quiet area of the primary winding since it exhibits a lower voltage swing, and that therefore it is logical to locate the secondary in the vicinity of winding 72. However, due to reasons of symmetry, the secondary winding 80 in '776 is positioned between primary windings 74 and 76.

Unlike in the single switch forward converter for which the '776 patent teachings were directed, the primary winding in a two switch forward converter is not connected to either the positive or the return side of the converter's input voltage. One drawback of the '776 patent, therefore, is that it does not address the unique problems in reducing common mode noise for a two switch forward converter. The '776 patent does not disclose, for instance, the optimum location for the secondary winding in a two switch forward converter.

U.S. Pat. No. 6,211,767 discloses a transformer having a secondary copper strip mounted and fixed on the primary winding PCB by means of solderable via holes, but does not disclose a design to significantly reduce common node noise.

A need therefore exists to reduce common mode noise for a planar transformer. The need especially exists to reduce common mode noise for a planar transformer designed for use in two FET forward converters and which can also be used in single ended, half bridge converters and push pull converters.

SUMMARY OF THE INVENTION

The present invention solves the problems of prior art devices by providing a method of construction of a planar transformer that minimizes capacitively coupled common mode noise from the primary winding to the secondary winding of the transformer. Broadly stated, the present invention comprises a method for reducing common mode noise coupling from the primary winding to the secondary winding in a transformer, wherein the primary winding includes first and second terminals and a plurality of coil turns therebetween formed by a plurality of printed circuit board (PCB) layers sandwiched together, each having at least one of the coil turns formed thereon, wherein the coils on each of the PCB layers are connected in a predetermined way to form the primary winding, and wherein the first terminal is connected to a coil on a first PCB layer and the second terminal is connected to a coil on a second PCB layer, comprising the steps of stacking the PCB layers to form the primary winding and positioning the secondary winding adjacent to a selected one of the PCB layers that is in a position in the stack that is substantially midway between the first and second PCB layers such that said secondary winding is positioned at a quiet point that exhibits the lowest voltage swing.

Broadly stated, according to another embodiment, in a transformer including a primary winding and first and second secondary windings, the primary winding having first and second terminals and a plurality of coil turns therebetween formed by a plurality of printed circuit board (PCB) layers sandwiched together, each having at least one of the coil turns formed thereon, wherein the coils turns on each the PCB layer are connected in a predetermined way to form the primary winding and wherein the first terminal is connected to a coil turn on a first PCB layer and the second terminal is connected to a coil turn on a second PCB layer, the present invention provides a method for reducing common mode noise coupling from the primary winding to the secondary winding comprising the steps of stacking a first half of the PCB layers including the first PCB layer to form a first half of the primary winding; stacking a second half of the PCB layers including the second PCB layer to form a second half of the primary winding; stacking the first and second halves to form the primary winding; positioning the first secondary winding adjacent to a selected one of the PCB layers in the first half of the primary winding in a position in the stack that is farthest from the first PCB layer; and positioning the second secondary winding adjacent to a selected one of the PCB layers in the second half of the primary winding in a position in the stack that is farthest from the second PCB layer.

Broadly stated, according to another embodiment, in a matrix transformer comprising first and second transformers, the first transformer including a first primary winding and first and second secondary windings, the first primary winding comprising a first series combination of windings connected in parallel with a second series combination of windings, the second transformer including a second primary winding and third and fourth secondary windings, the second primary winding comprising a third series combination of windings connected in parallel with a fourth series combination of windings, the first primary winding is connected in series with the second primary winding to form a third primary winding between first and second terminals, a parallel combination of the first and second secondary windings is connected in parallel with a parallel combination of the third and fourth secondary windings to form a fifth secondary winding; the third primary winding having a plurality of coil turns formed by a plurality of printed circuit board (PCB) layers sandwiched together, each having at least one of the coil turns formed thereon, wherein the coils turns on each the PCB layer are connected in a predetermined way to form the third primary winding and wherein the first terminal is connected to a coil turn on a first PCB layer and the second terminal is connected to a coil turn on a second PCB layer, the present invention provides a method for reducing common mode noise coupling from the third primary winding to the fifth secondary winding comprising the steps of stacking the PCB layers to form the third primary winding; and positioning each the parallel combination of secondary windings adjacent to a selected one of the PCB layers that is in a position in the stack that is substantially midway between the first and second terminals.

Broadly stated, the present invention also provides a planar transformer for reducing common mode noise comprising a plurality of printed circuit board (PCB) layers; a primary winding having first and second terminals and a plurality of coil turns therebetween formed by said plurality of printed circuit board (PCB) layers sandwiched together;

each having at least one of said coil turns formed thereon, wherein the coils turns on each said PCB layer are connected in a predetermined way to form said primary winding and wherein said first terminal is connected to a coil turn on a first PCB layer and said second terminal is connected to a coil turn on a second PCB layer; wherein a stack of said PCB layers forms said primary winding; and a secondary winding positioned adjacent to a selected one of said PCB layers that is in a position in said stack that is substantially midway between said first and second PCB layers such that said secondary winding is positioned at a quiet point that exhibits the lowest voltage swing.

An advantage of the present invention is improved EMI performance by reducing common mode noise coupled from the primary winding to the secondary winding in a power transformer.

Another advantage of the present invention is that it reduces the common mode noise coupled to the secondary winding without increasing the leakage inductance.

Still another advantage of the present invention is that is readily implemented in a planar transformer using PCB windings, which enables the number of turns of the primary winding in the contact surface between the primary and the secondary winding to be reduced to one turn for minimizing noise coupling.

Another advantage of the present invention is that it can be applied for both regular planar transformers and matrix planar transformer.

BRIEF DESCRIPTION OF THE DRAWINGS

The forgoing aspects and the attendant advantages of the present invention will become more readily appreciated by reference to the following detailed description, when taken in conjunction with the accompanying drawings, wherein.

DETAILED DESCRIPTION OF THE INVENTION

Figure 2:
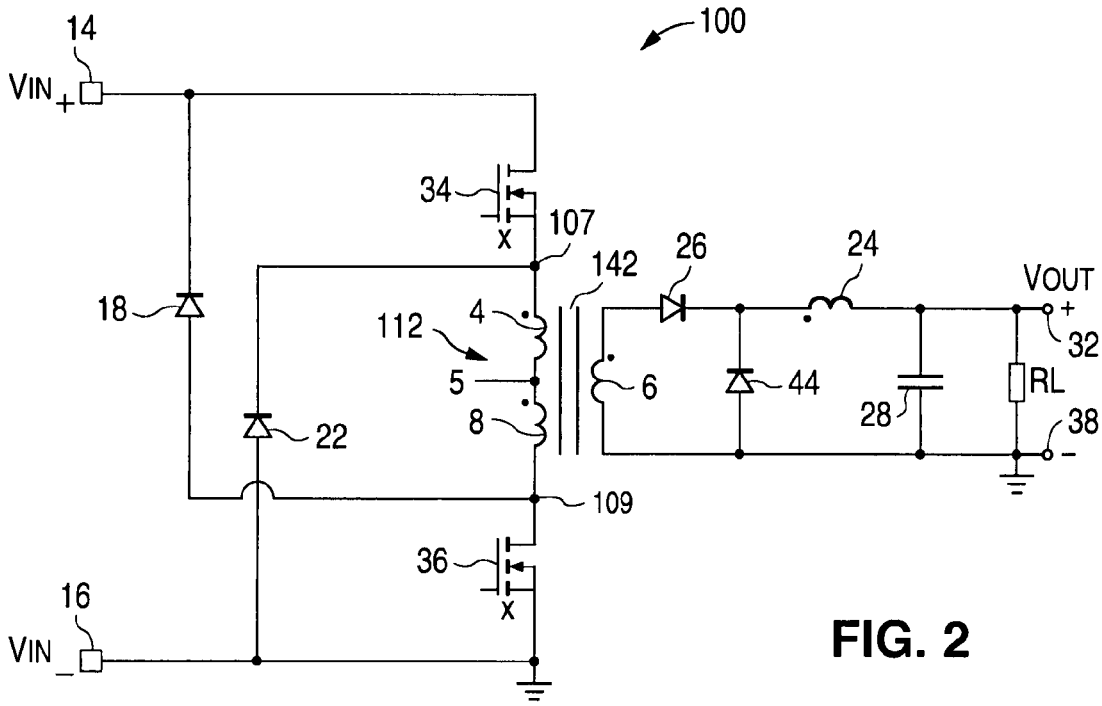
FIG. 2 shows a circuit diagram for a two switch forward converter of the present invention wherein the contact region between the primary winding and the secondary winding is the mid-portion of the primary winding.

FIG. 2 shows a circuit diagram for a two switch forward converter 100 having an embodiment of the transformer according to the present invention. Converter 100 has an input terminal 14 to which an input DC voltage, $V_{in}$, is coupled, relative to a ground potential at an input terminal 16, and an output terminal 32 where the output DC voltage, $V_{OUT}$, of the converter is provided relative to ground. Converter 100 includes a transformer 142 having a primary winding 112 and a secondary winding 6. Primary winding 112 comprises a first winding 4 and a second winding 8. Each winding has a first and second end. The second end of the first winding 4 is connected to the first end of second winding 8, at a node 5. A power switch 34 is coupled between the first end of first winding 4 at a node 107 and input terminal 14. A power switch 36 is connected to the second end of winding 8 at a node 109. The power switch 34 is connected in series with first winding 4, second winding 8, and power switch 36 across the input DC voltage terminals. A diode 18 is connected in series between the second end of winding 8 and the input terminal 14. A diode 22 is connected in series between the first end of winding 4 and the input terminal 16. Each of the power switches 34, 36 is preferably a MOSFET having a source, a drain, and a gate. A controller (not shown) provides a control signal, e.g. a pulse width modulated (PWM) signal, that is coupled to each control input of power switches 34 and 36.

For converter 100, the turns ratio of first winding 4 and second winding 8 are equal. During normal operation, the mid portion at node 5 between the first winding 4 and the second winding 8, i.e. the middle of the primary winding 112, exhibits the lowest voltage swing. The voltage level at node 5 is limited to about half of the input voltage. As a result, node 5 is the quiet point of primary winding 112, and therefore is the optimum contact region for the secondary winding 6. As seen in FIG. 2, the primary winding contact region for the secondary winding 6 is the middle of the primary winding 112.

Figure 3:
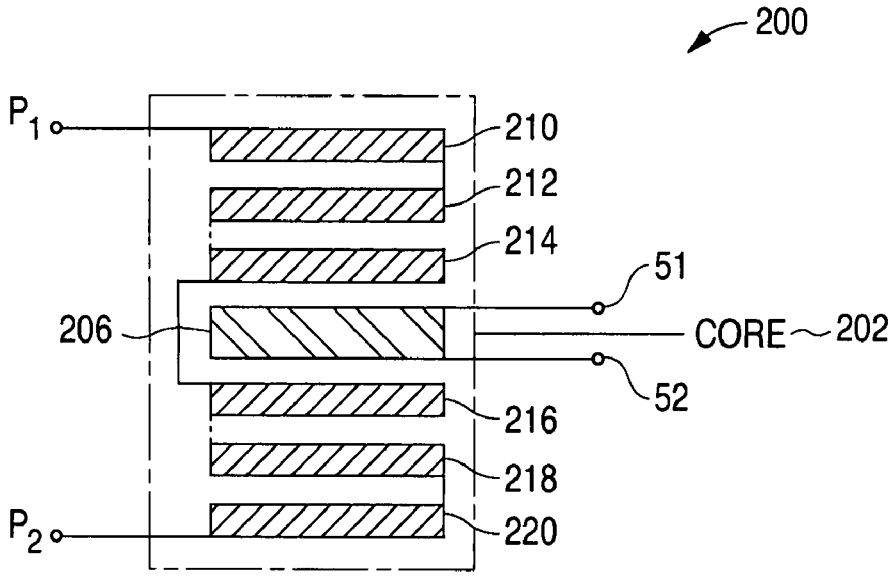
FIG. 3 illustrates the arrangement of the windings for a primary-secondary-primary ("pri-sec-pri") transformer constructed according to an embodiment of the present invention.
Figure 3A:
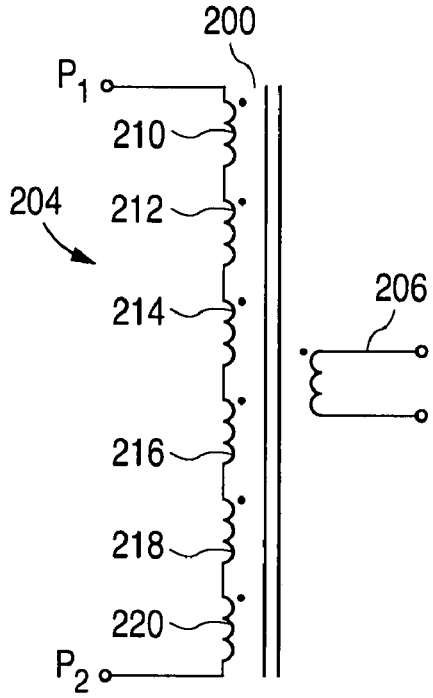
FIG. 3A shows a circuit diagram schematic representation of the sandwich pri-sec-pri transformer shown in FIG. 3.

FIG. 3 illustrates the arrangement of the windings for a primary-secondary-primary sandwich transformer 200. This primary-secondary-primary sandwich transformer construction shown in FIG. 3 is also referred to as a pri-sec-pri transformer construction. The sandwich transformer 200 has a primary winding 204, a secondary winding 206, and a core 202. The corresponding circuit diagram representation for transformer 200 is shown in FIG. 3A. Primary winding 204 comprises windings 210, 212, 214, 216, 218, and 220. Primary winding 204 has terminals P1 and P2. For the sandwich transformer 200, secondary winding 206 is sandwiched between the primary windings 210, 212, 214, 216, 218, and 220. Secondary winding 206 has terminals S1 and S2.

During normal operation, the mid-portion of primary winding 204, between windings 214 and 216, exhibits the lowest voltage swing. The voltage level between windings 214 and 216 is limited to about half of the input voltage. As a result, the point between windings 214 and 216 is the quiet point of primary winding 204 and thus the optimum contact region for the secondary winding 206. As seen in FIG. 3, the contact area (or region) for the secondary winding 206 is the quiet point between primary windings 214 and 216 in the middle of the primary winding 204.

Figure 1:
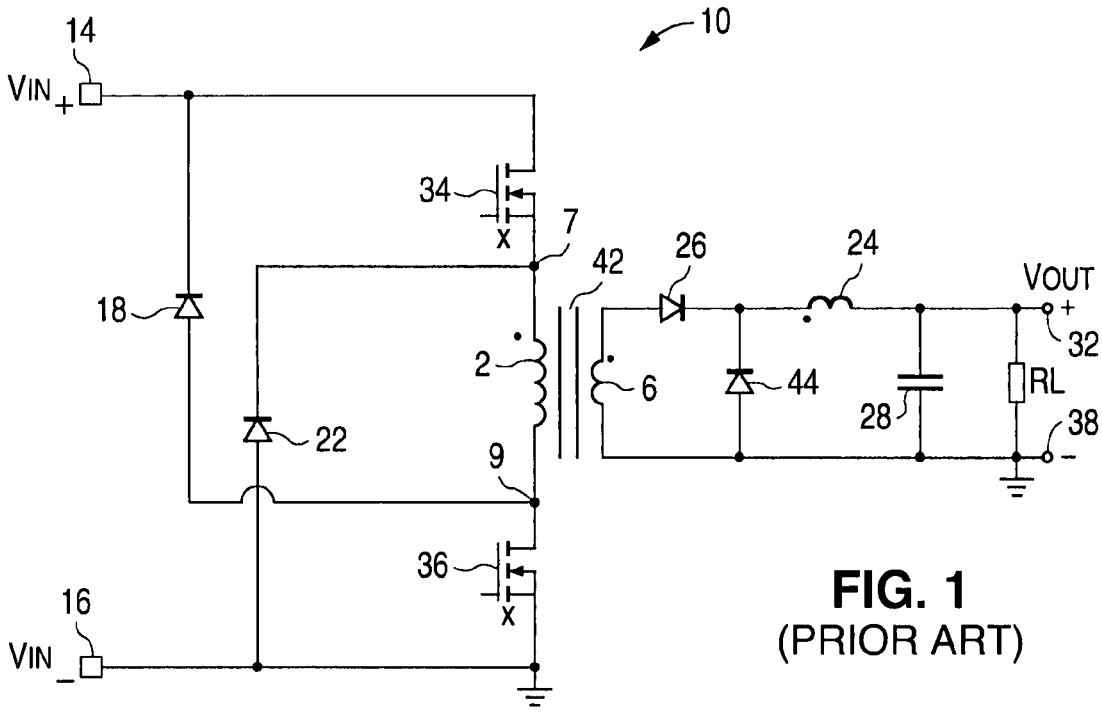
FIG. 1 (PRIOR ART)
FIG. 1 shows a circuit diagram for a prior art two switch forward converter.

When used in a two switch forward converter, e.g., as shown in FIGS. 1 and 2, the voltage swing in the primary winding 204 becomes larger for the winding turns that are closer to the drain of the MOSFETs. Conventionally, the sandwich transformer 200 could be constructed as a wire wound transformer, wherein each winding comprising a plurality of turns concentrically wound about a common axis. A drawback of such a wire wound sandwich transformer is that, if the number of turns in winding 214 and 216, shown in FIG. 3 is large, the common mode noise coupled to the secondary winding 204 is still large due to the large voltage swing in the windings 214 and 216. What is also needed is to reduce this additional source of common mode noise.

For a planar transformer, the windings and individual winding turns are formed from one or more conducting layers patterned on the surface of an insulating PCB layer, or on each layer of a multilayer PCB. Thus, for a planar transformer, the number of turns of the primary winding at the contact layer close to secondary winding can be as small as one turn. Thus, according to one embodiment of the present invention, the sandwich transformer 200 is constructed as a planar transformer wherein windings 214 and 216 are each preferably one turn. Since windings 214 and 216 each preferably comprise only one turn, the voltage swing at windings 214 and 216 at the contact layer close to the secondary winding 206 is reduced, thereby further reducing the common mode noise.

Figure 4:
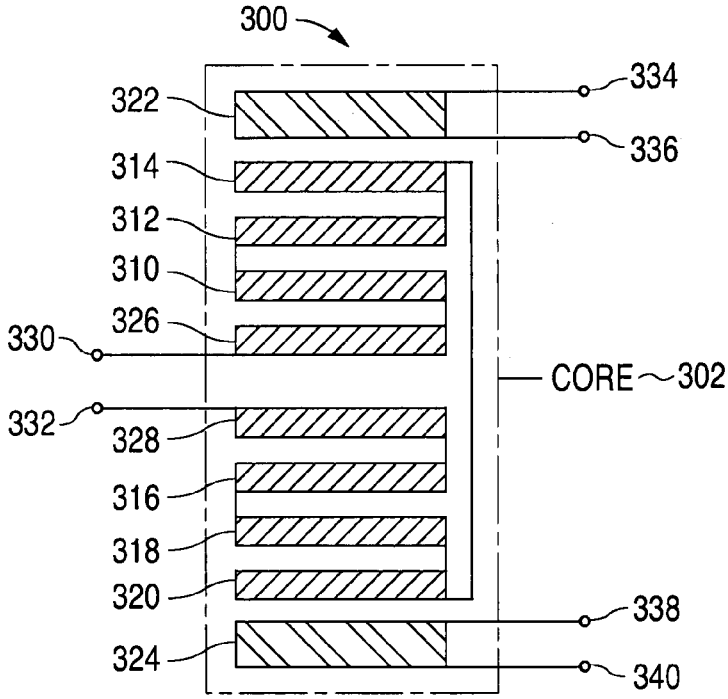
FIG. 4 illustrates the arrangement of the windings for a secondary-primary-secondary ("sec-pri-sec") transformer wherein two halves of the primary winding are combined into one PCB winding according to an embodiment of the present invention.
Figure 4A:
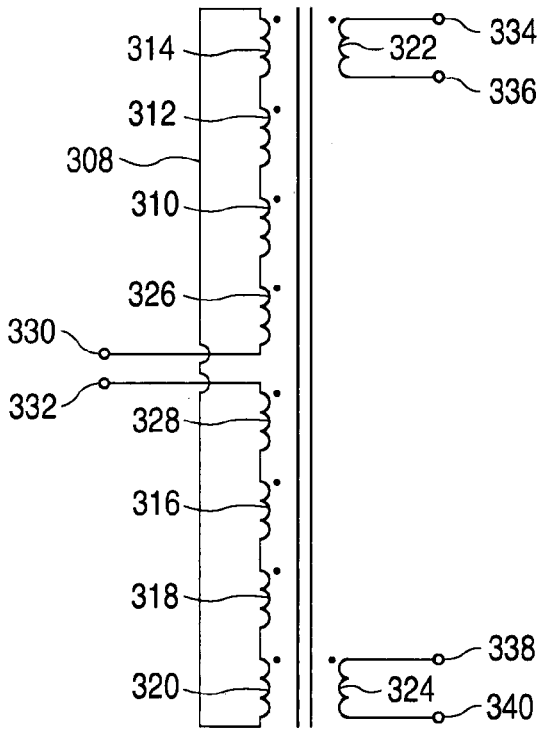
FIG. 4A shows a circuit diagram schematic representation of the sandwich sec-pri-sec transformer shown in FIG. 4.

FIG. 4 illustrates the arrangement of the windings for a sec-pri-sec transformer 300 wherein two halves of the primary windings are combined into one PCB winding according to an alternative embodiment of the present invention. FIG. 4A shows a circuit diagram schematic representation of the sec-pri-sec sandwich transformer in FIG. 4. Transformer 300 includes a primary winding 308 and secondary windings 322 and 324. Primary winding 308 has terminals 330 and 332. Secondary winding 322 has terminals 334 and 336. Secondary winding 324 has terminals 338 and 340. Primary winding 308 comprises a set of four windings 326, 310, 312, and 314 connected in series and another set of four windings 316, 318, 320, and 324 connected in series. The two sets of windings each comprise half of the primary winding 308. These two sets are connected in series to form primary winding 308.

As can be seen in FIG. 4A, for a planar embodiment comprised of sandwiched PCB layers, secondary winding 322 is adjacent to the layer on which primary winding 314 is formed and secondary winding 324 is adjacent to the layer on which primary winding 320 is formed.

The secondary windings 322, 324 are thus located at the furthest point from the terminals 330, 332 of primary winding 308, at a position that is farthest away from the largest source of common mode noise. Preferably, primary windings 314 and 320 each comprise one coil turn so as to further reduce the source of common mode noise for the corresponding adjacent secondary winding. Preferably, windings 314 and 320 are mounted on the same PCB so as to simplify construction.

Figure 5A:
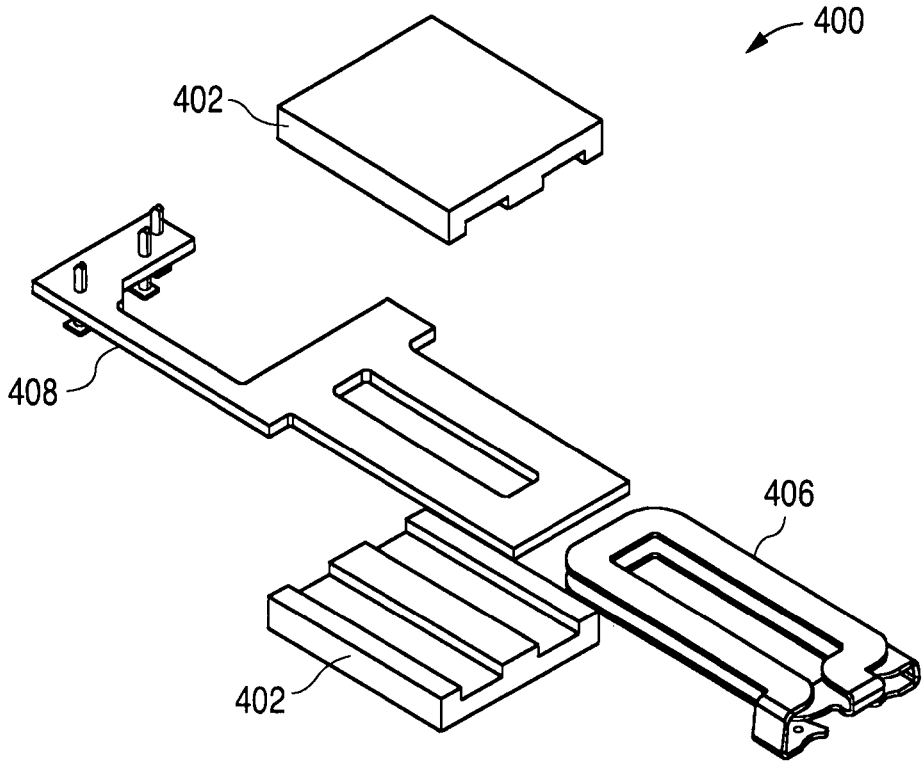
FIG. 5A is a partially exploded view of an exemplary layout for construction of a planar transformer according to a preferred embodiment of the present invention.
Figure 5C:
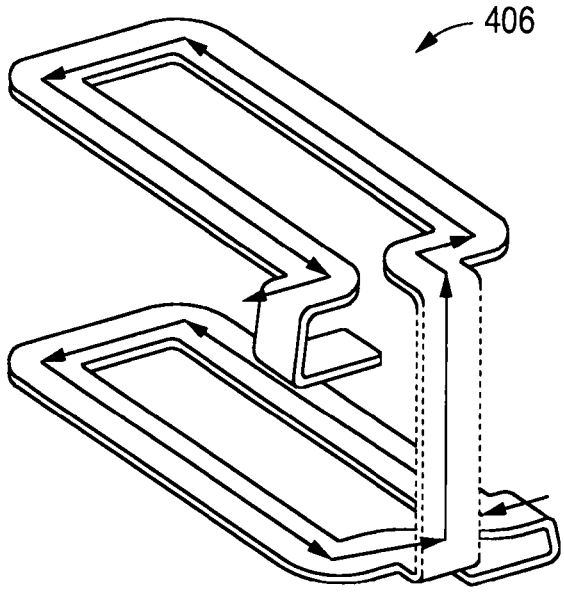
FIG. 5C illustrates an exemplary arrangement of the secondary PCB winding of FIG. 5A.
Figure 5B:
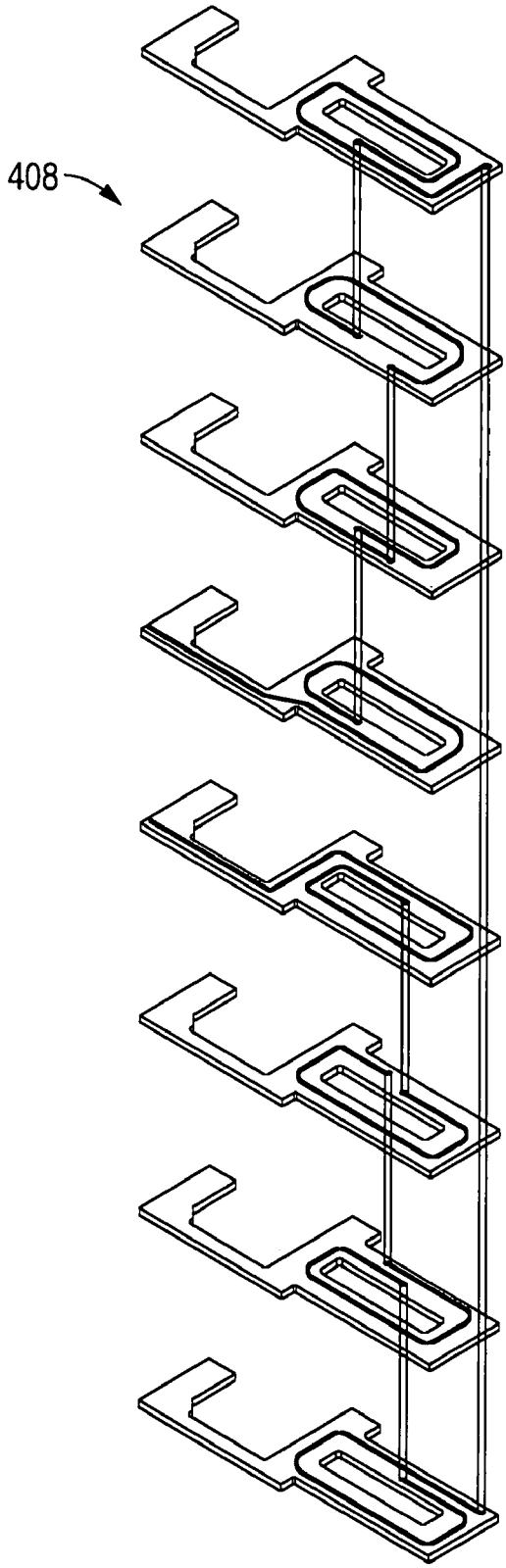
FIG. 5B illustrates an exemplary arrangement of the primary PCB winding assembly shown in FIG. 5A.

FIG. 5A is a partially exploded view of an exemplary layout for construction of a planar transformer 400 according to a preferred embodiment of the present invention. Planar transformer 400 has a core 402, a primary winding assembly 408, and a secondary winding assembly 406. FIG. 5B illustrates an exemplary arrangement of the primary PCB winding assembly 408. FIG. 5C illustrates a preferred arrangement of the secondary PCB winding 406 of planar transformer 400 constructed according to the present invention.

Figure 6:
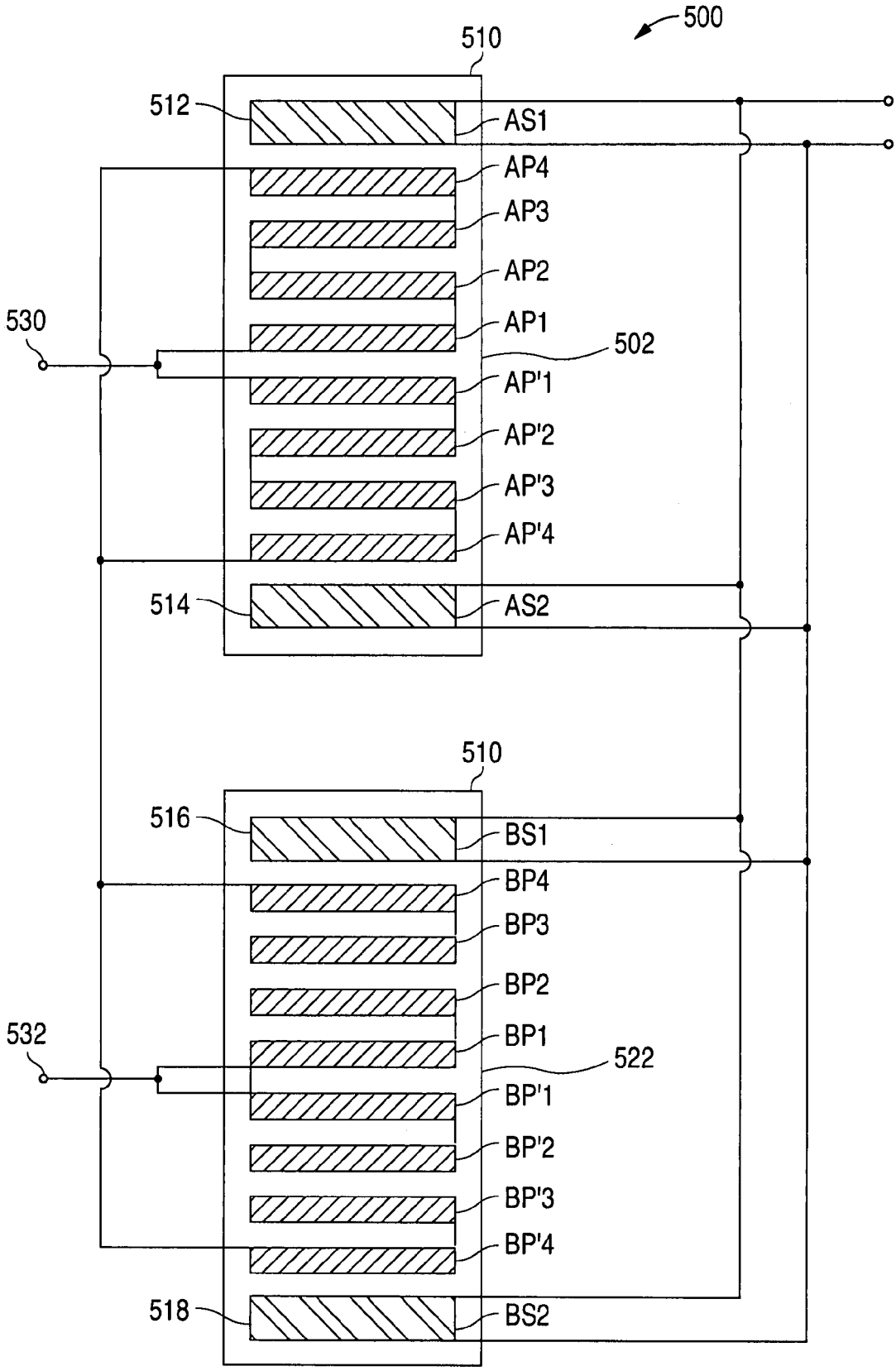
FIG. 6 illustrates the arrangement of the windings and core for an exemplary planar matrix transformer according to an embodiment of the present invention.
Figure 6A:
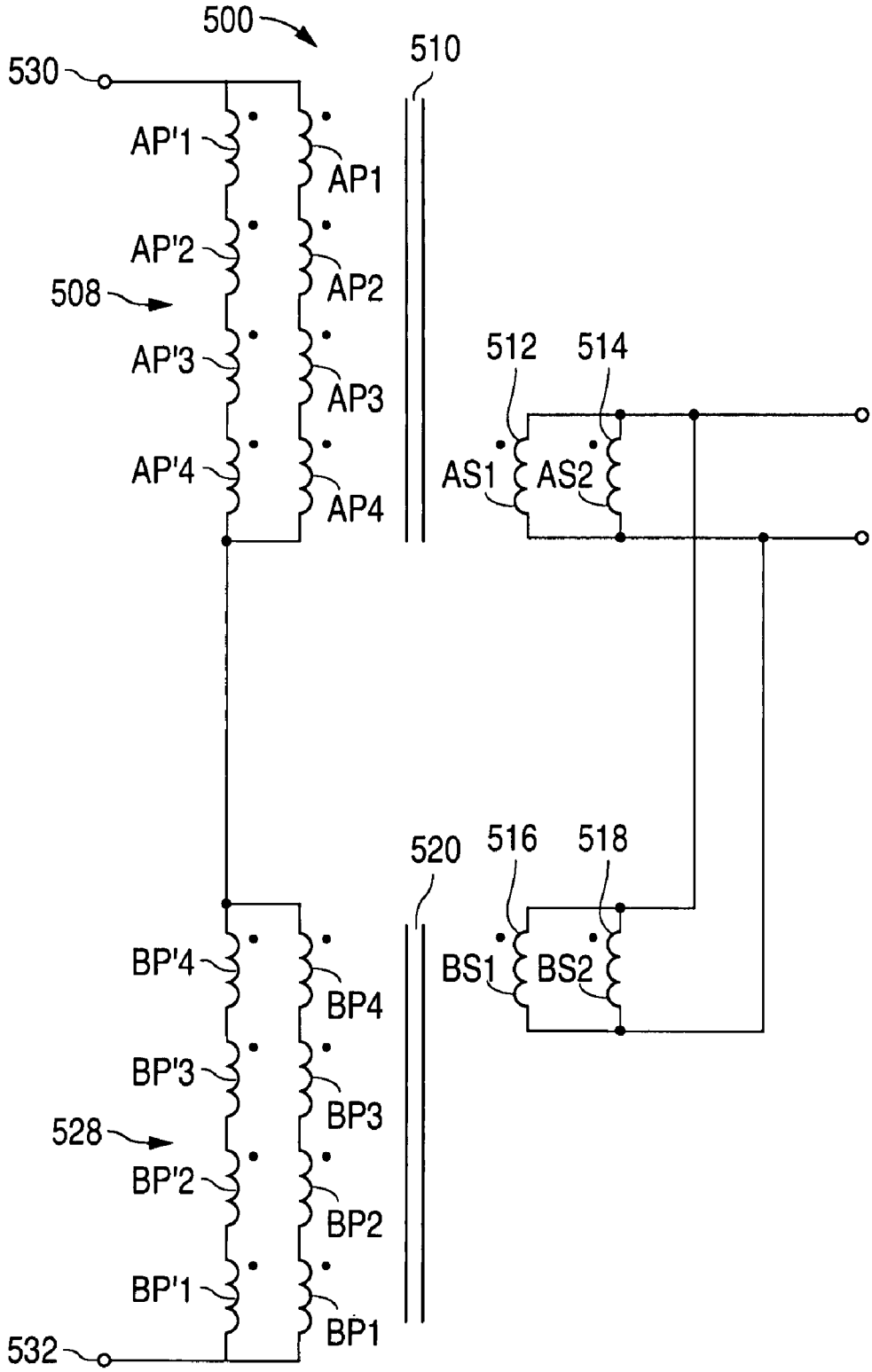
FIG. 6A is a circuit diagram for the matrix transformer shown in FIG. 6.

A matrix transformer is a planar transformer wherein two halves of the primary winding of the transformer are split and put into two different transformers. An alternative embodiment of the present invention is a transformer and corresponding PCB winding construction method for a low noise planar matrix transformer. FIG. 6 illustrates the arrangement of the windings and core for an exemplary planar matrix transformer 500 according to the present invention. FIG. 6A is a circuit diagram for the matrix transformer 500 shown in FIG. 6. The planar matrix transformer comprises a transformer 510 and a transformer 520. The AP'3, and AP'4, connected in parallel with a series combination of windings AP1, AP2, AP'3, and AP'4. The number of windings should be selected as required for a particular application. The primary winding 528 of transformer 520 comprises a series combination of windings BP'1, BP'2, BP'3, and BP'4 connected in parallel with a series combination of windings BP1, BP2, BP3, and BP4.

As seen in FIGS. 6 and 6A, for the planar matrix transformer 500, the primary winding 508 of transformer 510 is connected in series with the primary winding 528 of transformer 520. The series connected primary windings have terminals 530 and 532. The parallel combination of the secondary windings 512, 514 of transformer 510, also labeled as AS1 and AS2, is connected in parallel with a parallel combination of the secondary windings 516, 518 of transformer 520, also labeled as BS1 and BS2.

Figure 7A:
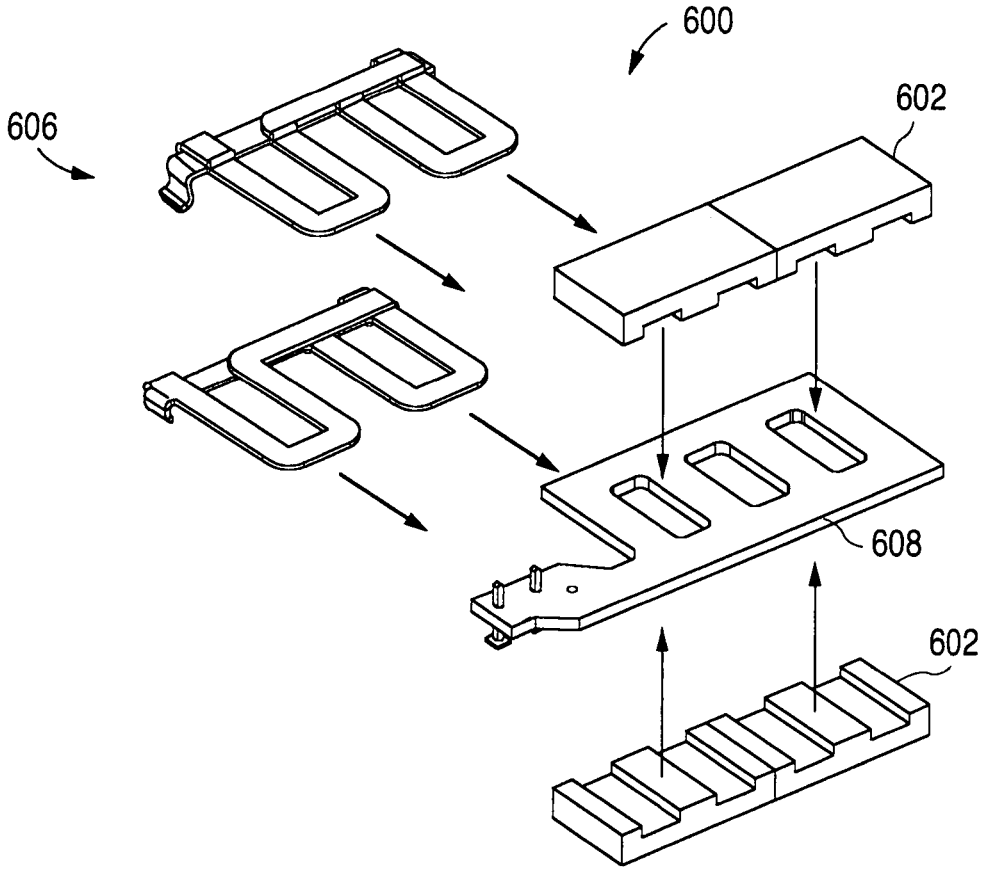
FIG. 7A is a partially exploded view of an exemplary layout for construction of a planar matrix transformer according to the embodiment of the present invention show in FIG. 6.
Figure 7B:
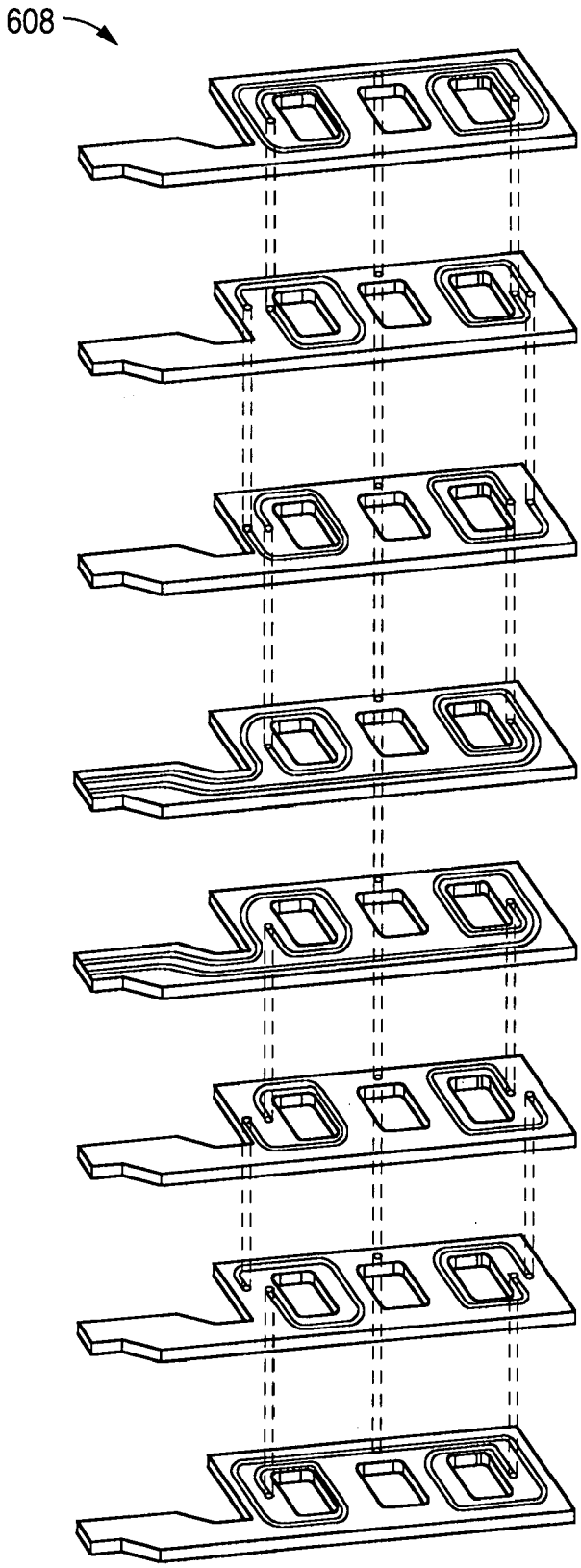
FIG. 7B illustrates an exemplary arrangement of the primary PCB winding assembly in FIG. 7A.
Figure 7C:
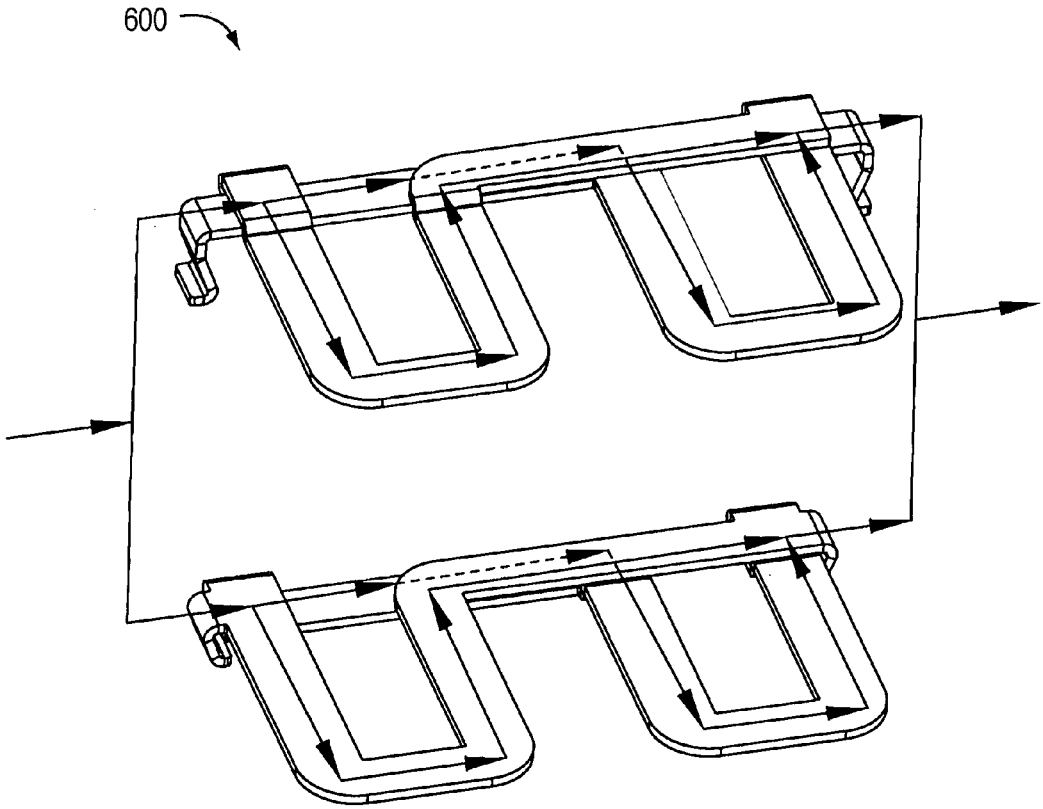
FIG. 7C illustrates an exemplary arrangement of the secondary PCB winding in FIG. 7A.

FIG. 7A is a partially exploded view of an exemplary layout for construction of a planar matrix transformer 600 according to the embodiment of the present invention shown in FIG. 6. Planar matrix transformer 600 has a core 602, a primary winding assembly 608, and a secondary winding assembly 606. FIG. 7B illustrates an exemplary arrangement of the primary PCB winding assembly 608. FIG. 7C illustrates an exemplary arrangement of the secondary PCB winding 606. As can be seen, multiple coil turns are preferably formed on each layer of the primary winding 608.

The foregoing detailed description of the invention has been provided for the purposes of illustration and description. Although exemplary embodiments of the present invention have been described in detail herein with reference to the accompanying drawings, it is to be understood that the invention is not limited to the precise embodiments disclosed, and that various changes and modifications to the present invention are possible in light of the above teaching.

What is claimed is:

1. A planar transformer for reducing common mode noise comprising:

at least four printed circuit board (PCB) layers;

a primary winding having first and second terminals and a plurality of coil turns therebetween formed by said at least four PCB layers sandwiched together; each said PCB layer having at least one of said coil turns formed thereon, wherein the coils turns on said PCB layers are connected in a predetermined way to form said primary winding;

wherein said at least four PCB layers are arranged in a stack which forms said primary winding, wherein a first one of said PCB layers is positioned at the top of said stack and said second one of said PCB layers is positioned at the bottom of said stack; wherein said first terminal is connected to a coil turn on said first PCB layer and said second terminal is connected to a coil turn on said second PCB layer; and a secondary winding positioned adjacent to a selected one of said PCB layers that is in a position in said stack at a point that is substantially midway between said first and second PCB layers, wherein at least one of said PCB layers in said stack is positioned between said secondary winding and said first PCB layer in said stack, and wherein at least one other of said PCB layers in said stack is positioned between said secondary winding and said second PCB layer in said stack, such that common mode noise coupling from said primary winding to said secondary winding is minimized.

2. A planar transformer for reducing common mode noise comprising:

at least four printed circuit board (PCB) layers;

a primary winding having first and second terminals and a plurality of coil turns therebetween formed by said at least four PCB layers sandwiched together; each said PCB layer having at least one of said coil turns formed thereon, wherein the coils turns on said PCB layers are connected in a predetermined way to form said primary winding;

wherein said at least four PCB layers are arranged in a stack which forms said primary winding, a first one of said PCB layers is positioned directly adjacent to a second one of said PCB layers in the middle of said stuck, and said first terminal is connected to a coil turn on said first PCB layer and said second terminal is connected to a coil turn on said second PCB layer; and a first secondary winding positioned adjacent to a selected one of said PCB layers that is positioned at the top of said stack; and a second secondary winding positioned adjacent to a selected one of said PCB layers positioned at the bottom of said stack; such that common mode noise coupling from said primary winding to said secondary winding is minimized.

3. In a matrix transformer comprising first and second transformers, said first transformer including a first primary winding and first and second secondary windings, said first primary winding comprising a first series combination of windings connected in parallel with a second series combination of windings, said second transformer including a second primary winding and third and fourth secondary windings, said second primary winding comprising a third series combination of windings connected in parallel with a fourth series combination of winding, said first primary winding is connected in series with said second primary winding to form a third primary winding between first and second terminals, a parallel combination of said first and second secondary windings is connected in parallel with a parallel combination of said third and fourth secondary windings to form a fifth secondary winding; said third primary winding having a plurality of coil turns formed by a plurality of printed circuit hoard (PCB) layers sandwiched together, each having at least one of said coil turns formed thereon, wherein the coils turns on each said PCB layer are connected in a predetermined way to form said third primary winding and wherein said first terminal is connected to a coil turn on a first PCB layer and said second terminal is connected to a coil turn on a second PCB layer, a method for reducing common mode noise coupling from said third primary winding to said fifth secondary winding comprising the steps of:

stacking said PCB layers to form said third primary winding; and positioning said parallel combination of said first and second secondary windings adjacent to a selected one of said PCB layers of said first primary winding that is substantially farthest from said first terminal; and positioning said parallel combination of said third and fourth secondary windings adjacent to a selected one of said PCB layers of said second primary winding that is substantially farthest from said second terminal.

4. The method of claim 3 wherein multiple coil turns are formed on each said layer of said third primary winding.

5. A planar transformer for reducing common mode noise comprising:

at least four of printed circuit board (PCB) layers;

a primary winding having first and second terminals and a plurality of coil turns therebetween formed by said least four printed circuit board (PCB) layers sandwiched together; each said PCB layer having at least one of said coil turns formed thereon, wherein the coils turns on said PCB layers are connected in a predetermined way to form said primary winding, and wherein said first terminal is connected to a coil turn on a first one of said PCB layers and said second terminal is connected to a coil turn on a second one of said PCB layers;

wherein said at least four PCB layers arc arranged in a stack which forms said primary winding, said stack comprising said first PCB layer, said second PCB layer, and at least two other of said PCB layers;

a secondary winding positioned in said stack said first, wherein at least one of said other PCB layers in said stack is positioned between said secondary winding and said first PCB layer, and wherein at least one other of said PCB layers in said stack is positioned between said secondary winding and said second PCB layer in said stack, such that common mode noise coupling from said primary winding to said secondary winding is minimized.

6. The planar transformer of claim 5 wherein said planar transformer reduces common mode noise coupling from said primary winding to said secondary winding in a two switch forward converter.

7. The planar transformer of claim 5, wherein said secondary winding is positioned adjacent to a selected one of said PCB layers that is in a position in said stack that is substantially-midway between said first and second PCB layers.

8. The planar transformer of claim 5, wherein said primary winding is formed by at least X PCB layers arranged in said stack, and wherein at least ((X/2)−1) layers of said stack are positioned between said secondary winding and both said first and second PCB layers in said stack.

9. A method for forming a transformer including a primary winding and a secondary winding, wherein said primary winding is formed from at least four printed circuit board (PCB) layers arranged in a stack, said stack comprising said first PCB layer, said second PCB layer, and at least two other of said PCB layers, each PCB layer having at least one coil turn formed thereon, said primary winding having a first and a second terminal and a plurality of coil turns therebetween, comprising the steps of:

connecting said coil turns in a predetermined way;

connecting said first terminal to a coil turn on a corresponding first PCB layer and said second terminal to a coil turn on a corresponding second PCB layer; and positioning said secondary winding in a position in said PCB stack farthest from said first and second PCB layers, wherein at least one of said other PCB layers in said stack is positioned between said secondary winding and said first PCB layer, and wherein at least one other of said PCB layers in said stack is positioned between said secondary winding and said second PCB layer in said stack, such that common mode noise coupling from said primary winding to said secondary winding is minimized.

10. The method of claim 9, wherein said positioning step further comprises:

positioning said secondary winding adjacent to a selected one of said PCB layers that is in a position in said stack that is substantially midway between said first and second PCB layers such that said secondary winding is positioned at a quiet point that exhibits the lowest voltage swing.

11. The method of claim 1, wherein said PCB layer closest to said secondary winding comprises only one coil turn so as to further reduce common mode noise coupling.

12. The method of claim 9, wherein said primary winding is formed by the connection of the coil turns on each said PCB layer and wherein said positioning step further comprises positioning said secondary winding adjacent to a selected one of said PCB layers that is in a position in said stack that is substantially midway between said first and second PCB layers.

13. The method of claim 12, wherein said PCB layer closest to said secondary winding comprises only one coil turn so as to further reduce common mode noise coupling.

14. The method of claim 9, wherein said secondary winding is a first secondary winding and said transformer includes a second secondary winding, said method further comprising:

slacking a first half of said PCB layers including said first PCB layer to form a first half of said primary winding;

stacking a second half of said PCB layers including said second PCB layer to form a second half of said primary winding;

stacking said first and second halves to form said primary winding;

positioning said first secondary winding adjacent to a selected one of said PCB layers in said first half of said primary winding in a position in said stack that is substantially furthest from said first PCB layer; and positioning said second secondary winding adjacent to a selected one of said PCB layers in said second half of said primary winding in a position in said stack that is substantially farthest from said second PCB layer.

* * * * *